US008571238B2

(12) United States Patent
Plath et al.

(10) Patent No.: US 8,571,238 B2
(45) Date of Patent: Oct. 29, 2013

(54) MICROPHONE

(75) Inventors: Frank Plath, Wedemark (DE); Jan Watermann, Hannover (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 681 days.

(21) Appl. No.: 12/602,998

(22) PCT Filed: Jun. 6, 2008

(86) PCT No.: PCT/EP2008/057086

§ 371 (c)(1),
(2), (4) Date: Sep. 20, 2010

(87) PCT Pub. No.: WO2008/148875

PCT Pub. Date: Dec. 11, 2008

(65) Prior Publication Data

US 2011/0007924 A1 Jan. 13, 2011

(30) Foreign Application Priority Data

Jun. 8, 2007 (DE) ..... 10 2007 027 011

(51) Int. Cl.
*H04R 3/00* (2006.01)

(52) U.S. Cl.
USPC ..... 381/122

(58) Field of Classification Search
USPC ..... 381/122
See application file for complete search history.

(56) References Cited

U.S. PATENT DOCUMENTS

| | | | | |
|---|---|---|---|---|
| 4,002,859 | A * | 1/1977 | Schoeps et al. | 381/113 |
| 4,484,029 | A | 11/1984 | Kenney | |
| 6,608,569 | B2 * | 8/2003 | Herold et al. | 340/999 |
| 2004/0264703 | A1 | 12/2004 | Fujita | |
| 2005/0221859 | A1 * | 10/2005 | Wang et al. | 455/557 |

FOREIGN PATENT DOCUMENTS

| | | | |
|---|---|---|---|
| AT | 268400 | | 2/1969 |
| DE | 905494 | | 3/1954 |
| DE | 4032007 | A1 | 12/1991 |
| WO | WO 2008/148875 | A1 | 12/2008 |

OTHER PUBLICATIONS

Search Report for PCT/EP2008/057086 mailed on Sep. 18, 2008; 2 pages.
Written Opinion for PCT/EP2008/057086 mailed on Sep. 18, 2008;5 pages.

* cited by examiner

*Primary Examiner* — Alexander Jamal
(74) *Attorney, Agent, or Firm* — Kilpatrick Townsend & Stockton LLP

(57) ABSTRACT

Thus there is provided a microphone (10) having a first end (12) with a first slip ring (100) which is divided into at least first and second segments (GND, 300). The first slip ring (100) co-operates with a microphone head (12) when the microphone head (12) is fastened to the first end (12) of the microphone by means of a screw connection. The microphone further has a detection unit (16) coupled to the at least first and second segments (GND, 300) of the first slip ring (100) to detect rotation of the microphone head (12).

4 Claims, 3 Drawing Sheets

MICROPHONE

CROSS-REFERENCE TO RELATED APPLICATIONS

Figure 1:
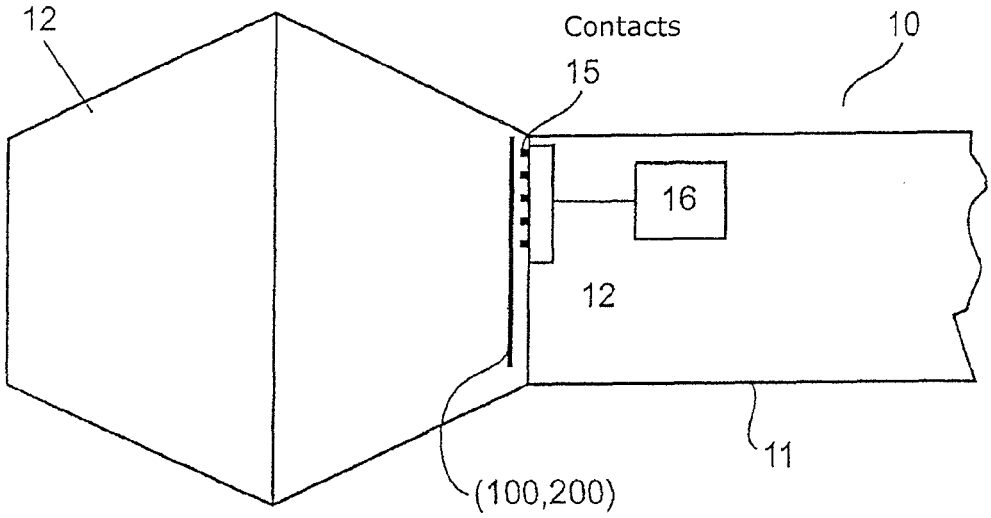

This application is a U.S. National Stage of PCT Application No. PCT/EP2008/057086 filed Jun. 6, 2008, which claims the benefit of German Application No. 102007027011.0 filed Jun. 8, 2007, the contents of both applications hereby incorporated by reference in their entirety for all purposes.

The present invention concerns a microphone.

Particularly in the case of microphones which have a replaceable microphone head it is desirable to detect a change in a microphone head. In conventional microphones use is made for that purpose for example of leading contacts when the microphone head is contacted by means of a plug connection.

As state of the art attention is directed to DE 905 494 B, DE 40 32 007 A1, AT 268 400 B and U.S. Pat. No 4,002,859.

The object of the present invention is to provide a microphone in which a change in a microphone head can be easily and reliably detected.

That object is attained by a microphone as set forth in claim 1.

Thus there is provided a microphone having a first end with a first slip ring which is divided into at least first and second segments. The first slip ring co-operates with the microphone head when the microphone head is fastened to the first end of the microphone by means of a screw connection. The microphone further has a detection unit coupled to the at least first and second segments of the first slip ring to detect rotation of the microphone head.

In accordance with an aspect of the invention the microphone has a second slip ring having a plurality of third and fourth segments, and an identification unit coupled to the third and fourth segments of the second slip ring to provide for identification of the microphone head when it is screwed on.

In accordance with a further aspect of the present invention the third and fourth segments are arranged in encoded fashion.

In accordance with a further aspect of the present invention a first resistor is arranged in the microphone head and a second resistor is provided in the microphone housing. The first resistor is electrically connected to the second resistor when the first slip ring is contacted with contacts on the microphone housing. A measurement voltage is applied to the second resistor. A voltage between the first and second resistors is measured in order thereby to determine the first resistor with the microphone head and thus to identify the microphone.

The invention also concerns a microphone having a replaceable microphone head and a microphone housing. The microphone further has a second slip ring with a plurality of third and fourth segments, a first resistor in the microphone head and a second resistor in the microphone housing. The first resistor is electrically connected to the second resistor when the first slip ring is contacted with contacts on the microphone housing. A measurement voltage is applied to the second resistor. A voltage between the first and second resistors is measured in order thereby to determine the first resistor in the microphone head and thus to identify the microphone head.

The invention concerns the concept of detecting whether a microphone head of a microphone is rotated, for example for it to be replaced. If a rotation of the microphone head is detected the audio signal of the microphone can be muted so that it is possible to prevent contacts of the microphone head causing noises in the rotary movement. As an alternative thereto the microphone can be at least partially deactivated. There is provided a first slip ring having a plurality of segments. Furthermore, by detecting the rotation of the microphone head it is possible to detect whether a microphone head is screwed on to or into the microphone again. As soon as the microphone head has been screwed on to or into the microphone items of information in respect of the type of microphone head can optionally be read out. According to an aspect of the invention identification of the microphone head can be effected by means of a second slip ring during or after the microphone head has been screwed on or upon rotation of the microphone head. It is thus possible to provide a microphone which permits early detection of the rotation of the microphone and optionally identification of the type of microphone head.

Further configurations of the invention are subject-matter of the appendant claims.

Advantages and embodiments of the invention are described in greater detail hereinafter with reference to the drawing.

Figure 3:
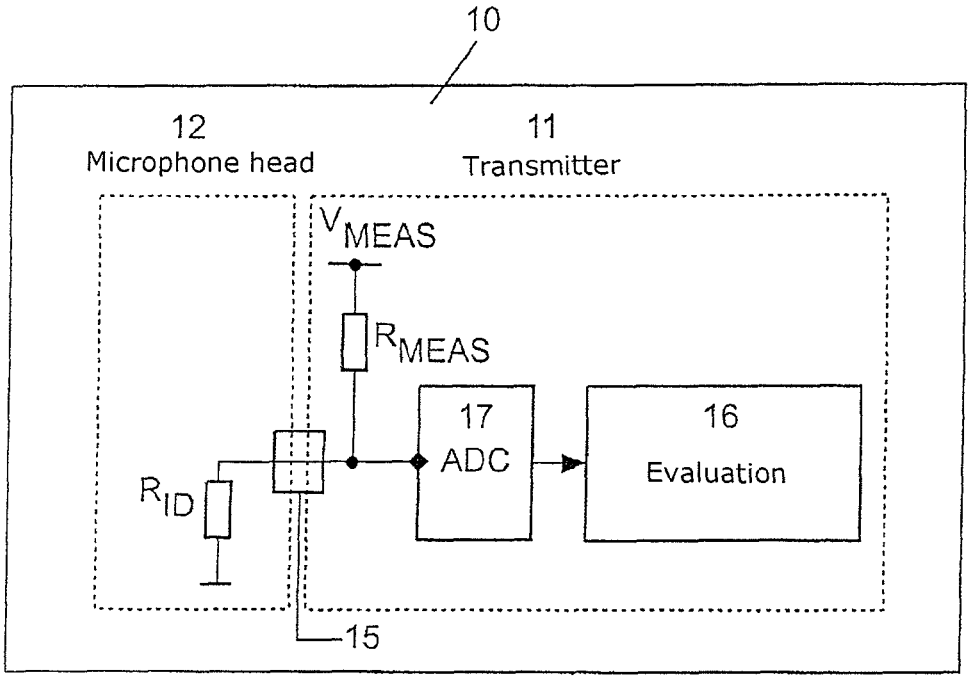
Figure 2A:
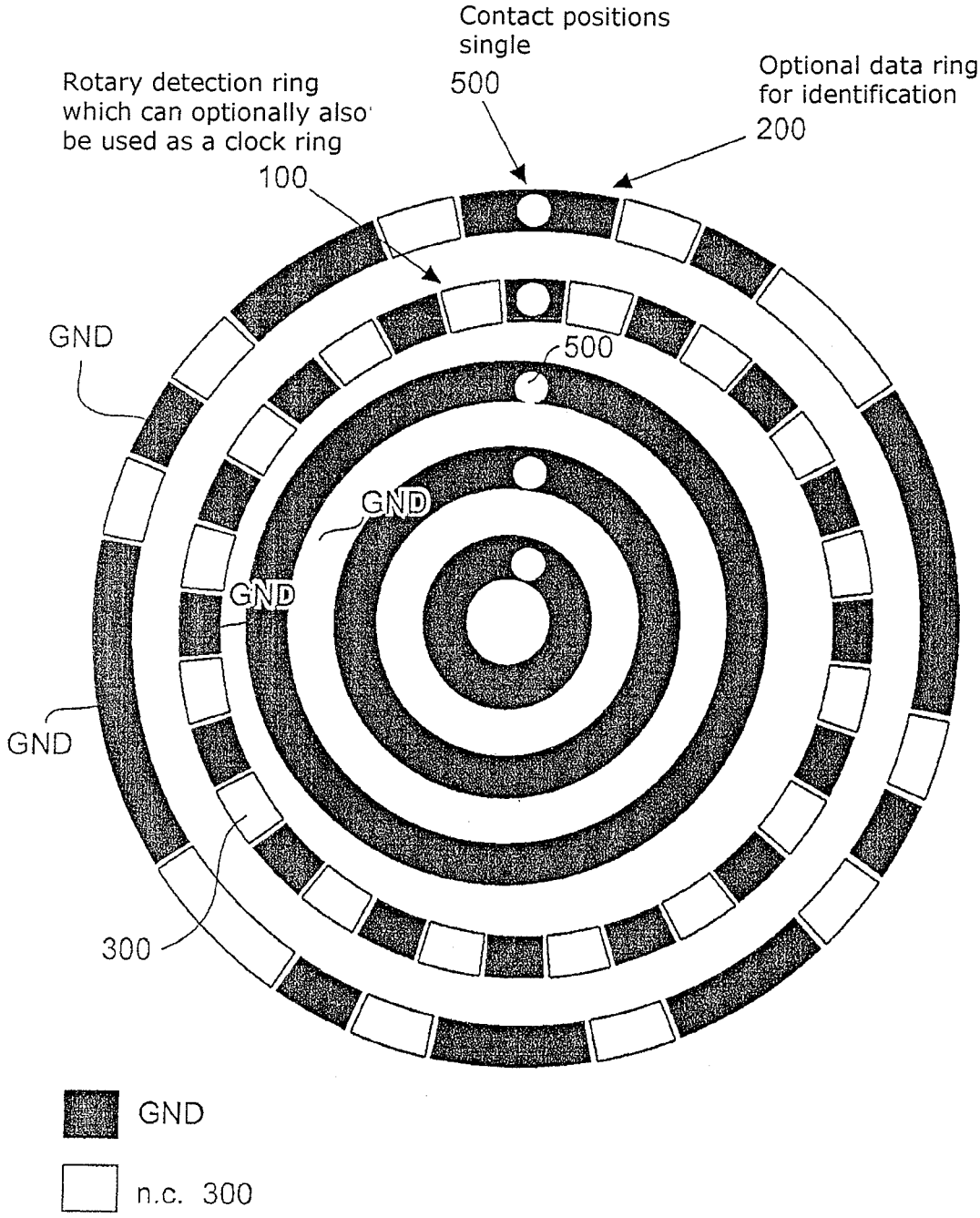
Figure 2B:
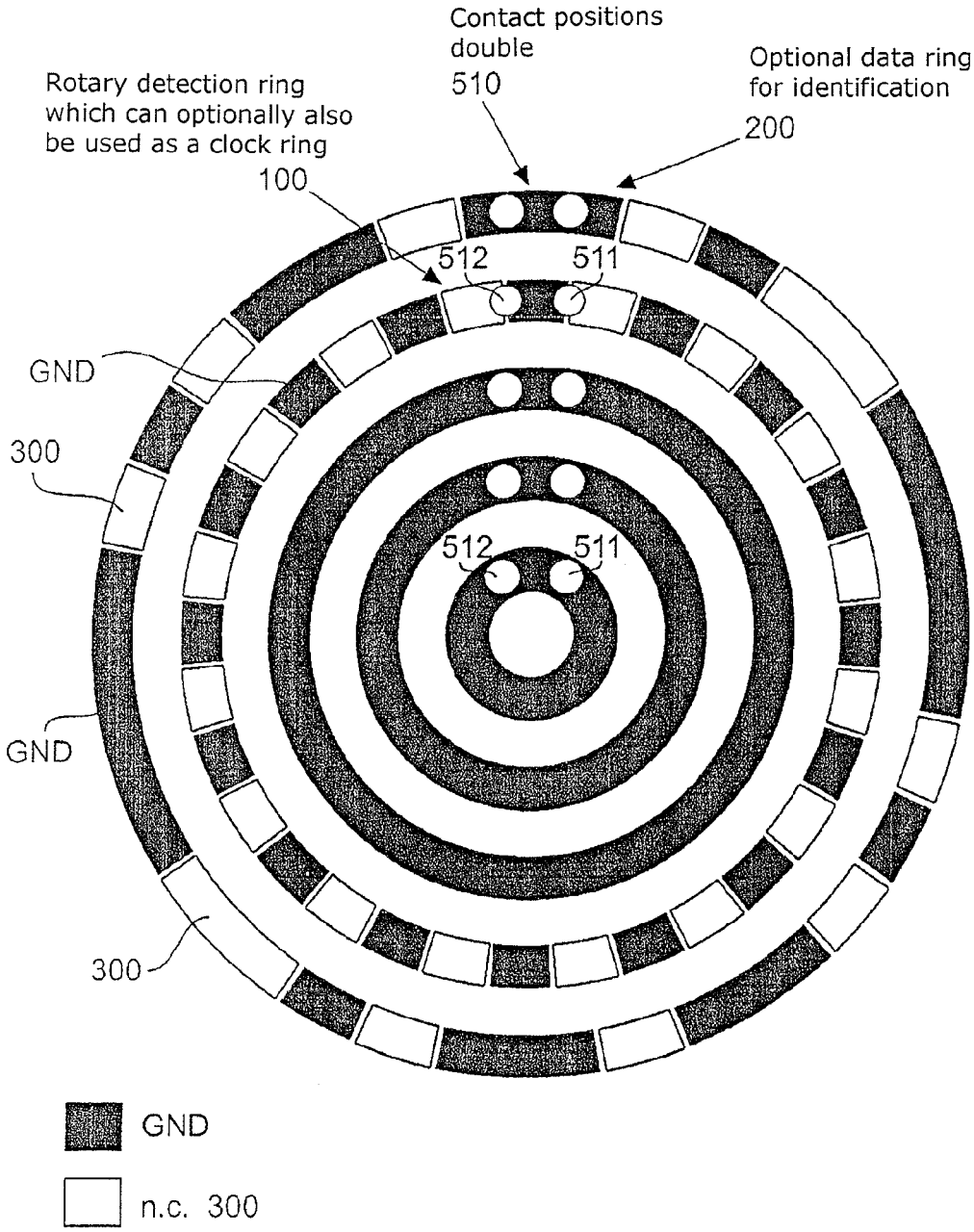

FIG. 1 shows a diagrammatic view of a microphone according to the invention, FIGS. 2*a* and 2*b* each show a diagrammatic view of slip rings in a microphone according to the invention, and FIG. 3 shows a diagrammatic circuit in a microphone according to the invention.

FIG. 1 shows a diagrammatic view of a microphone according to the invention. The microphone 10 has an end 13 to which a microphone head 12 is fastened, preferably screwed. The microphone head has at least one slip ring 100, 200 co-operating with contacts 15 at the first end 13 of the microphone housing 11. The contacts 15 are connected to a detection unit 16 for detecting rotation of the microphone head 12.

FIGS. 2*a* and 2*b* each show a diagrammatic view of slip rings in a microphone according to the present invention. For that purpose the microphone 10 has a first end 13 to which a microphone head 12 can be fastened for example by means of a screw connection. The microphone head 12 typically has a microphone capsule for the conversion of audio signals. The microphone head 12 is preferably of a replaceable or interchangeable design so that a multiplicity of different microphone heads can be used with the microphone.

The first slip rings 100 in FIG. 1 are arranged at the first end 13 of the microphone. The first slip ring 100 serves as a detection ring and has a multiplicity of segments (first and second segments). In this arrangement adjacent segments are at different potentials. Thus a multiplicity of first segments GND is connected to ground while a multiplicity of second segments 300 is not connected or is connected to a different potential.

In addition to the first slip ring 100 a second slip ring 200 can optionally be provided. That second slip ring 200 serves as a data ring for identifying the microphone head. The second slip ring 200 is also subdivided into a multiplicity of a plurality of in particular third and fourth segments, wherein the first multiplicity of segments is connected to ground and the second multiplicity of segments is not connected or is connected to a different potential.

When now the microphone head 12 is screwed on to the first end 11 of the microphone, rotation of the microphone head 12 occurs, and rotation of the microphone head 12 and thus rotation of the first slip ring 100 relative to the contacts 15, 500 generates an alternating digital signal. That digital signal can be detected and evaluated by means of a detection unit 16 in the microphone. That unit 16 can be implemented for example in the form of a microcontroller, an FPGA or a discrete circuit. Thus by means of the alternating digital signal it is possible to detect whether the microphone head 12 is or is not being rotated. If rotation of the microphone head is detected then the audio output signal of the microphone can be muted. If no further rotation occurs the audio output signal of the microphone can be enabled again.

For reliable contacting of the microphone head in the screwed-on condition, it is possible to provide two spring contacts 500, 512, 511 in the microphone head 12 or at the first end 11 of the microphone, which are alternately connected to a respective one of the segments to provide a higher level of contact reliability.

The second slip ring 200 is optional and serves for identification of the microphone head. Identification of the microphone during the rotation of the microphone head can be effected by means of the second slip ring 200. In that case the third and fourth multiplicities of segments of the second slip ring can be arranged in encoded relationship, that is to say the segments are preferably not arranged at uniform spacings. The segments can be arranged for example as a binary sequence comprising a 7-bit Barker code, 8-bit data and 1-bit parity. If a Barker code is used it is possible to find the beginning of the sequence. The parity bit serves in that case to find errors in a simple fashion.

The first slip ring 100 has a first and second multiplicity of segments which are segmented at uniform spacings. That arrangement of the segments means that the first slip ring 100 can serve to generate a clock signal during identification by the second slip ring 200 upon rotation of the microphone head (and therewith the first slip ring relative to the contacts 15, 500).

According to a further embodiment of the invention identification of the microphone head 12 can be effected by means of the data ring 200 without the first slip ring 100 being used. Thus in this embodiment the first slip ring 100 is only optionally provided. The identification function in this embodiment corresponds to the above-described function of identifying the microphone head.

FIG. 3 shows a diagrammatic view of a microphone in a further embodiment. The microphone has a microphone head 12 with a resistor $R_{ID}$ and a transmitter or a housing 11 with a resistor $R_{MEAS}$, optionally an A/D converter 17 and an evaluation unit 16. A measurement voltage $V_{MEAS}$ is applied to the resistor $R_{MEAS}$. When the microphone 12 is screwed on to the housing 11, contacting of the microphone head is effected by means of the slip rings and the contacts 15 so that the resistor $R_{ID}$ of the microphone head 12 is electrically connected to the resistor $R_{MEAS}$ in the housing 11 and the A/D converter 17. That thus provides a voltage divider with the two resistors. The resistor $R_{ID}$ is selected specifically for each type of microphone head so that clear identification is possible. By measuring the voltage between the two resistors it is possible to determine which resistor is provided in the microphone head 12 so that corresponding identification of the microphone head 12 can be effected.

Identification of the microphone head can thus be effected as soon as there is an electrical contact between the microphone head and the housing 11 of the microphone as from that moment in time the voltage between the two resistors can be read off and correspondingly evaluated.

The invention claimed is:

1. A microphone for generating an audio output signal comprising:

a replaceable microphone head, a first end with a first slip ring which is divided into at least first and second segments wherein the first slip ring co-operates with the microphone head when the microphone head is fastened to the first end of the microphone by means of a screw connection, and a detection unit coupled to the at least first and second segments of the first slip ring to detect rotation of the microphone head when the microphone head is replaced, wherein the detection unit is configured to mute the audio output signal of the microphone when a rotation of the microphone head is detected.

2. A microphone comprising:

a replaceable microphone head and a microphone housing, a first resistor in the microphone head, and a second resistor in the microphone housing, wherein the first resistor is electrically connected to the second resistor when the microphone head is fastened to the microphone housing, wherein a measurement voltage is applied to the second resistor and wherein a voltage between the first and second resistors is measured in order to determine the first resistor with the microphone head and thus to identify the microphone head.

3. A microphone comprising:

a replaceable microphone head, and a microphone housing, and a first resistor in the microphone head, the microphone head comprising at least one slip ring for co-operating with contacts at a first end of the microphone housing, wherein the first resistor is connector to the at least one slip ring, and wherein the first resistor is selected specifically for a type of a microphone head permitting identification of the type of microphone head by determining the resistor provided in the microphone head.

4. A microphone for generating an audio output signal comprising:

a microphone housing having a first end, and a replaceable microphone head, comprising at least a first slip ring, wherein the first slip ring is divided into at least first and second segments, and wherein the first slip ring co-operates with first contacts at the first end of the microphone housing when the microphone head is fastened to the first end of the microphone housing by means of a screw connection, and a detection unit connected to the first contacts for detecting rotation of the microphone head when the microphone head is replaced, wherein the detection unit is configured to mute the audio output signal of the microphone when a rotation of the microphone head is detected.

* * * * *

UNITED STATES PATENT AND TRADEMARK OFFICE

CERTIFICATE OF CORRECTION

PATENT NO. : 8,571,238 B2
APPLICATION NO. : 12/602998
DATED : October 29, 2013
INVENTOR(S) : Plath et al.

It is certified that error appears in the above-identified patent and that said Letters Patent is hereby corrected as shown below:

In the Specification:

In column 1, line 14, please insert a --,-- after “head”.

In column 1, line 15, please insert a --,-- after “microphones”.

In column 1, line 16, please insert a --,-- after “purpose” and after “contacts”.

In column 1, line 19, please insert a --,-- after “art”.

In column 1, line 34, please insert a --,-- after “invention”.

In column 1, line 39, please insert a --,-- after “invention”.

In column 1, line 42, please insert a --,-- after “invention”.

In column 2, line 7, please delete “on to” and insert --onto--.

In column 2, line 8, please delete “on to” and insert --onto--.

In column 2, line 9, please insert a --,-- before “items”.

In column 2, line 11, please insert a --,-- after “invention”.

In column 2, line 22, please delete “drawing” and insert --drawings--.

In column 2, line 30, please delete “13”.

In column 2, line 33, please delete “13”.

Signed and Sealed this
Eleventh Day of February, 2014

Michelle K. Lee

Michelle K. Lee
*Deputy Director of the United States Patent and Trademark Office*

In column 2, line 39, please delete “13”.

In column 2, line 47, please delete “13”.

In column 2, line 49, please insert a --,-- after “arrangement”.

In column 2, line 51, please delete “is connected” and insert --are connected--.

In column 2, line 52, please delete “is not” and insert --are not--; please delete “is connected” and insert --are connected--.

In column 2, line 54, please insert a --,-- after “100”.

In column 2, lines 57-58, please delete “a plurality of in particular”.

In column 2, line 59, please delete “first” and insert --third--; please delete “is” and insert --are--.

In column 2, line 60, please delete “second” and insert --fourth--; please delete “is not” and insert --are not--; please delete “or is” and insert --or are--.

In column 2, line 62, please delete “now”; please delete “on to” and insert --onto--.

In column 2, line 63, please delete “11”.

In column 3, lines 3-4, please insert a --,-- after “signal”.

In column 3, line 6, please insert a --,-- after “detected”.

In column 3, line 7, please insert a --,-- after “occurs”.

In column 3, line 10, please delete “two”.

In column 3, line 12, please delete “11”.

In column 3, line 34, please insert a --,-- after “invention”.

In column 3, lines 46-47, please delete “on to” and insert --onto--.

In column 3, line 51, please delete “That thus” and insert --This--.

In column 3, line 54, please insert a --,-- after “resistors”.

<u>In the Claims</u>:

In column 4, line 37, please delete “connector” and insert --connected--.